United States Patent [19]

Bostic

[11] 4,191,534

[45] Mar. 4, 1980

[54] FUEL LOG AND METHOD OF MAKING IT

[76] Inventor: Joseph M. Bostic, P.O. Box 121, White Sulphur Springs, W. Va. 24986

[21] Appl. No.: 926,093

[22] Filed: Jul. 19, 1978

[51] Int. Cl.[2] ..... C10L 9/00; C10L 5/00

[52] U.S. Cl. ..... 44/6; 44/10 R; 44/15 R; 44/38; 427/421

[58] Field of Search ..... 44/6, 15 R, 15 A, 10 R, 44/38; 427/421

[56] References Cited

U.S. PATENT DOCUMENTS

| | | | |
|---|---|---|---|
| 1,932,815 | 10/1933 | Doherty | 44/6 |
| 2,076,315 | 4/1937 | Albrecht | 44/10 R |
| 2,176,128 | 10/1939 | Fife | 44/6 |
| 3,297,419 | 1/1967 | Eyre, Jr. | 44/6 |
| 4,078,902 | 3/1978 | Olson | 44/16 A |

*Primary Examiner*—Carl F. Dees
*Attorney, Agent, or Firm*—Lowe, King, Price & Becker

[57] ABSTRACT

A novel fuel log is manufactured by pulverizing raw, carbonaceous material to form granules which are mixed with binder in a hopper and then compacted under pressure to form cylindrical logs. To assure thorough mixing of granules and binder, the binder is sprayed inwardly from the hopper wall while the granules are dispensed from above to drop through the spray. The binder thus tends to coat the entire surface of each granule prior to compaction. Because the surface of each granule is uniformly coated with binder, no voids or discontinuities in the structure are formed. The resulting fuel log is highly resistant to chipping and fracturing, and burning is more uniform.

10 Claims, 7 Drawing Figures

FUEL LOG AND METHOD OF MAKING IT

TECHNICAL FIELD

The present invention relates generally to coal logs and methods of making them, and more particularly, to an improved fuel log formed of carbonaceous granules and a binder that are mixed together in air to improve the resistance to chipping and burning characteristics of the finished product.

BACKGROUND ART

Various prior art methods and apparatus have been used to manufacture artificial fuel logs of which I am aware by mixing together sawdust or coal granules with a binder and extruding the mixture into the form of a cylindrical log. In U.S. Pat. No. 2,076,315 to Albrecht, for example, pulverized coal is mixed with Portland cement in a mixing hopper to form a briquette paste that is supplied to a horizontal cylinder for compaction into individual briquettes. The coal and cement, initially combined in the hopper, are temporarily stored in the mixed state prior to compaction into briquettes. In U.S. Pat. No. 4,049,392 to Furman, coal briquettes are formed by an extruder screw that receives a particulate mixture comprising coal and a binder premixed together in a mixing hopper and fed gradually to the extruder as needed during briquette production. In methods of this type, mixing of coal and binder is imperfect, however, causing formation of voids or discontinuities throughout the log. As a result, burning tends to be discontinuous, and there is also a tendency for the outer surface of the log to chip or fracture during shipping, causing the logs to be ultimately unacceptable for commercial sale.

Accordingly, one object of the present invention is to provide a new and improved fuel log that is smooth burning and resistant to chipping or fracturing.

Another object is to provide a method for forming a fuel log from carbonaceous material and binder, wherein particles are bound together to form a continuous mass without voids or discontinuities.

Another object is to provide an apparatus for manufacturing a fuel log, wherein carbonaceous particles are individually and uniformly coated with binder before compaction to eliminate structural voids or discontinuities.

Another object is to provide a method of and apparatus for manufacturing artificial fuel logs that are economical and suitable for mass production.

DISCLOSURE OF INVENTION

A fuel log, in accordance with the invention, is formed of carbonaceous granules having a diameter of less than about 0.25 inch coated with a combustible, liquid binder in a mixing hopper and then compacted in an extruder into the form of a cylindrical log. Raw coal is first pulverized into the granules and distributed onto a moving conveyor operating at a speed that causes the granules to be uniformly spread in no more than a few layers. The coal granules are transported on the conveyor to the mouth of the mixing hopper where the granules are dropped through the hopper to the extruder. Combustible binder is sprayed onto the falling granules from spray nozzles distributed on the wall of the hopper. Because coal granules tend to separate from each other as they drop through the hopper, the entire surface of each granule becomes uniformly coated with the binder prior to compaction. Thus, all space between granules in the compacted, finished product becomes occupied by binder, preventing development of voids.

The log is extruded into the center of a cylindrical jacket formed of cardboard or other combustible material. The jacketed log is then cut into equal sections and the exposed ends of each section are covered by a pair of cardboard end caps. A pull tab is formed in the cardboard jacket to function as a low kindling temperature starter for the log.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR CARRYING OUT THE INVENTION

Figure 1A:
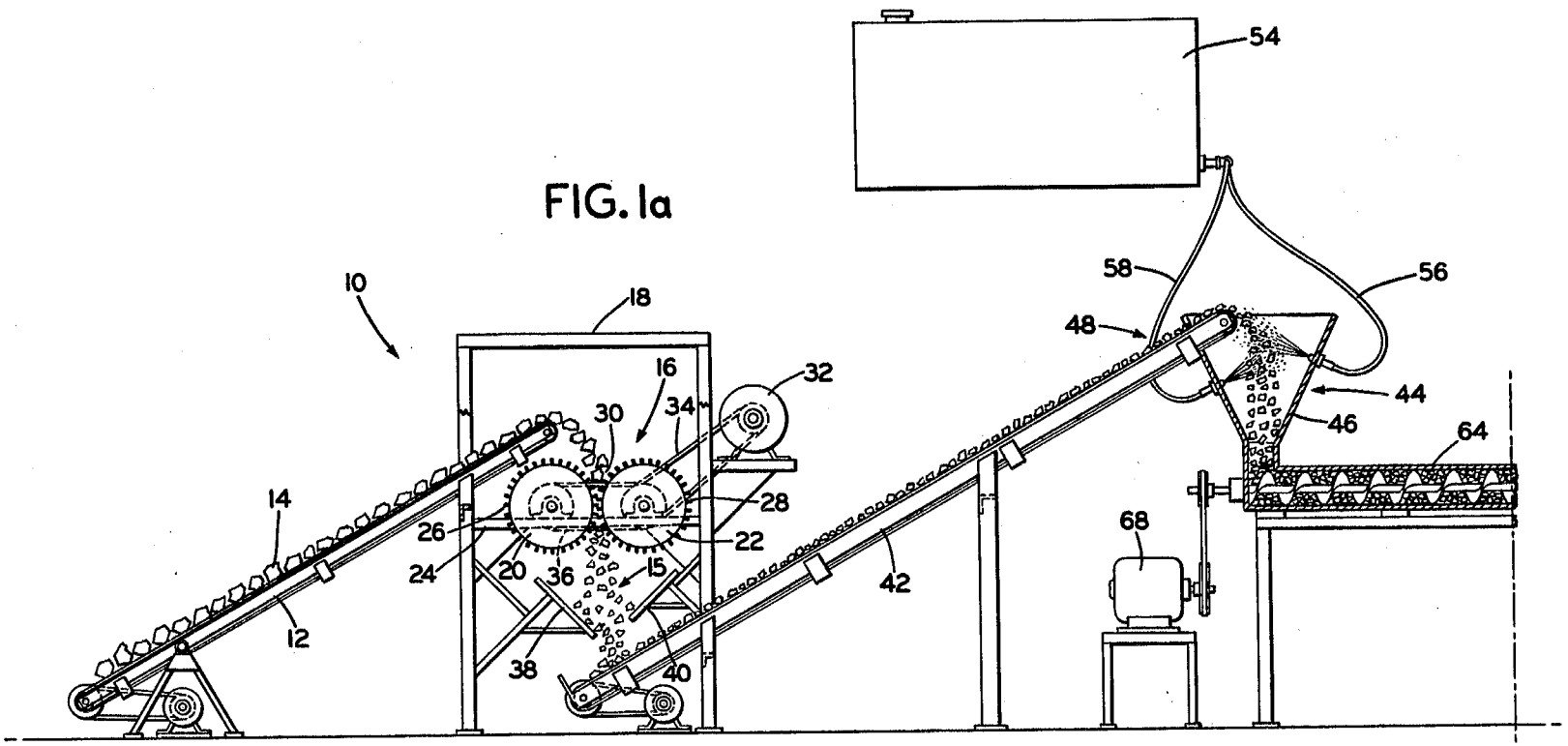
FIG. 1*a* is a side view of one portion of an apparatus for making the fuel log of the present invention.
Figure 1B:
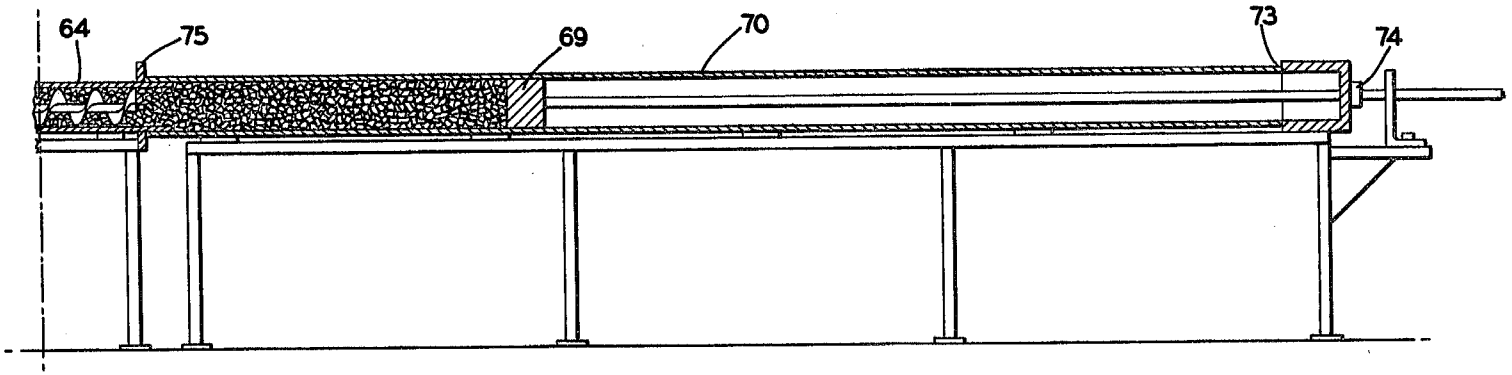
FIG. 1*b*, is a side view of a second portion of the apparatus shown in FIG. 1*a;*

Referring to FIGS. 1*a* and 1*b*, an apparatus 10, in accordance with the invention, comprises a first conveyor 12 onto which is positioned raw coal 14 to be transported upwardly to a coal pulverizer 16 supported in frame 18. The pulverizer 16 comprises a pair of pulverizer wheels 20 and 22 located on a horizontal beam 24 and positioned with pulverizing teeth 26 and 28 meshing with each other at a nip 30 into which the raw, mined coal in the form of granules 14 is dropped. The pulverizer is adjusted to produce granules 15 having diameters of no more than about 0.25 inch. The pulverizer wheels 20 and 22 are operated by a motor 32 through a first drive belt 34 between the motor and wheel 22 and a second drive belt 36 between the two wheels 20 and 22. Coal guides 38, 40 are located below the pulverizer 16 to guide the coal granules 15 onto the foot of a second conveyor 42.

The conveyor 42 transports the coal granules 15 upwardly to the mouth of a mixing hopper 44. The speed of movement of the conveyor 42 is controlled to cause granules 15 to be evenly distributed along the length of the conveyor in no more than a few layers, the limited opening defined by the inclined coal guides 38, 40 that feeds conveyor 42 tending to limit the depth of the granules 15 on the conveyor by retarding the flow of granules onto the foot of the conveyor.

Figure 2:
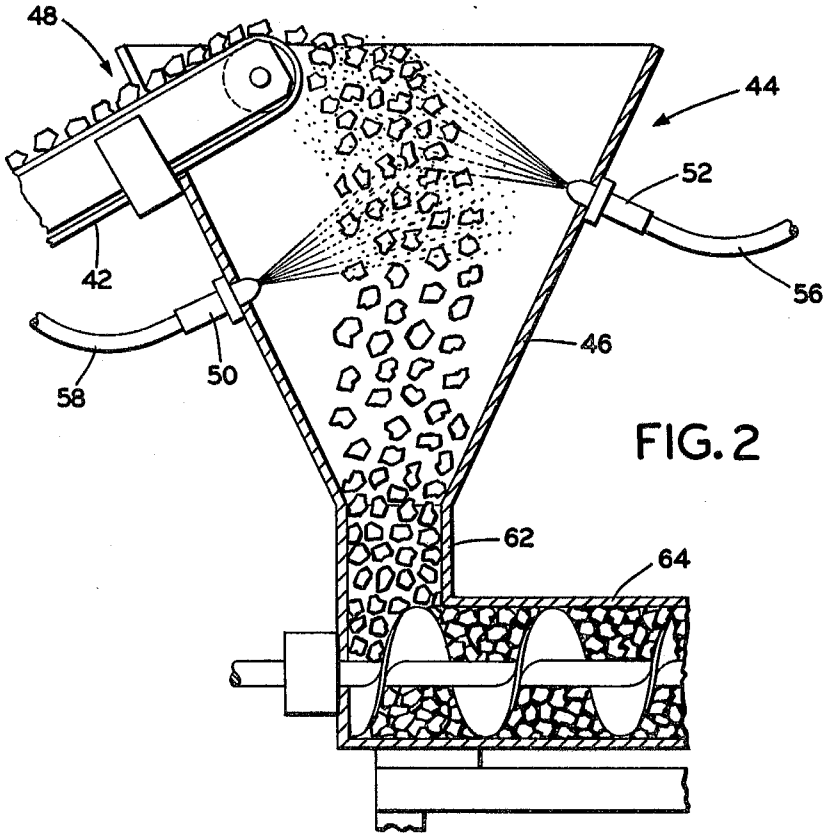
FIG. 2 is a cross-sectional view of the mixing hopper showing carbonaceous granules dropping through a binder spray within the hopper.

Hopper 44, which is shown in more detail in FIG. 2, comprises a funnel-shaped wall 46 having an upper end 48 onto which is located the feed end of conveyor 42. A pair of binder spray nozzles 50 and 52 are positioned through the wall 46 of hopper 44 to spray a liquid binder as a dense mist toward the center of the hopper. The nozzles 50 and 52 receive the liquid binder from a storage tank 54 (FIG. 1*a*) through conduits 56 and 58. The binder is preferably Professional Contact Cement, manufactured by Borden Industries, New York, although any other suitable fast setting, flammable, liquid binder could be used. The binder is sprayed into the hopper 44 at a rate of one ounce of binder per six pounds of pulverized coal.

Of particular importance, because the coal granules 15 are evenly distributed in only a few layers on conveyor 42, and due to the granule diameter of no more than about 0.25 inch, I have found that the coal granules tend to separate from each other during free fall in the hopper. The separation of granules is believed to be assisted by air turbulence within the hopper caused by intersection of the falling granules 15 and radially directed mist of liquid binder. At the moment of contact with the binder spray, the individual coal granules 15 are out of contact with each other and also out of contact with the hopper wall; the entire surface of each coal granule thereby being uniformly coated with a layer of the binder while in flight. The binder-coated granules, identified by numeral 60, now accumulate at the stem 62 of hopper 44.

Referring to FIG. 2, the binder-coated granules 60 in hopper stem 62 are compacted in extruder 64 by a screw 66 that is rotated by a motor 68 (FIG. 1*a*). Pressure for compaction of the fuel log material egressing from extruder 64 is provided by a plunger 69 supported on a bearing 71 that also clamps end 73 of cardboard jacket 70 in cooperation with extruder outlet collar 75 (FIG. 1*b*).

Figure 5:
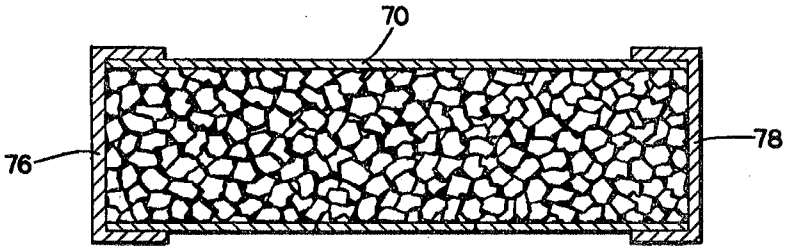
FIG. 5 is a cross-sectional view of the jacket showing the fuel log contained therein and end caps.

Because each coal granule 15 has been uniformly coated with binder along its entire surface prior to accumulation in the hopper stem 62, all space between adjacent granules is filled with binder, as best shown in FIG. 5. There are thus no voids or discontinuities or planes along which fracturing can occur in the compacted product.

Figure 3:
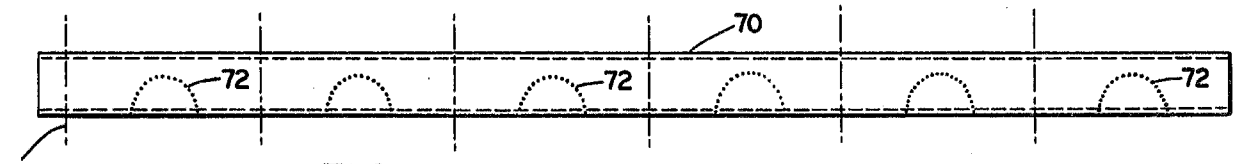
FIG. 3 is a schematic view showing cutting lines for separating individual fuel logs from a large log produced in the apparatus of FIG. 1.
Figure 4:
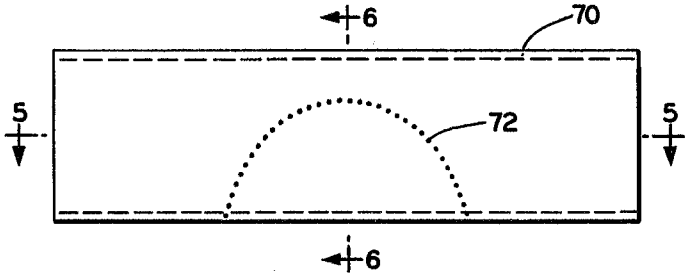
FIG. 4 is a front view of a cardboard jacket of the type used in the present invention.
Figure 6:
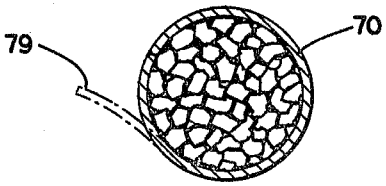
FIG. 6 is a cross-sectional end view of the jacketed fuel log showing the operation of the pull tab.

Referring to FIG. 1*b*, the compacted granules/binder mixture constituting the fuel log material is extruded into a long, cylindrical jacket 70 formed of cardboard or other combustible material. In practice, the cardboard jacket is fourteen feet in length and six inches in diameter. In a subsequent cutting operation, the fourteen feet long cardboard jacket and fuel log material stored therein are cut into equal sections defined by lines 71 to form individual fuel logs (6 pounds per log, in practice), as shown in FIG. 3. The exposed ends of the log are covered by a pair of cardboard end caps 76 and 78, as shown in FIG. 5. Score lines 72 (FIG. 4) are formed on the cardboard jacket 70 of each of the logs to define a pull tab 74 (FIG. 6) that has a relatively low kindling temperature and is used to "start" the log during burning.

In this disclosure, there is shown and described only the preferred embodiments of the invention, but, as aforementioned, it is to be understood that the invention is capable of use in various other combinations and environments and is capable of changes or modifications within the scope of the invention concept as expressed herein. For example, it is apparent that suitable materials other than raw coal may be used as the fuel source, and also that suitable combustible materials other than cardboard may be used as the jacket. Also, the cylindrical shape of the log is arbitrary, any other elongate shape being within the scope of the invention contemplated.

I claim:

1. A method of making fuel logs, comprising the steps of pulverizing mined coal to form coal granules; spreading the granules in no more than a few layers onto a conveyor; conveying the granules on the conveyor to a position above a hopper; dispensing the granules from the conveyor into the hopper at a rate to cause individual granules to separate from each other while dropping said granules through air within said hopper; laterally spraying a flammable liquid contact cement toward the center of said hopper from at least one wall mounted, spray nozzle to uniformly coat the surface of each granule dropping through the spray; and compacting the cement-coated granules to form a fuel log.

2. The method of claim 1, wherein said granules have a diameter of about 0.25 inch.

3. The method of claim 2, including the step of locating said compacted log into an elongate, combustible covering jacket, and cutting the jacketed fuel log into equal length sections, and covering exposed ends of said logs with combustible covering end caps.

4. The method of claim 3, wherein said liquid contact cement is sprayed into said hopper at a rate of about one ounce of liquid cement per six pounds of granules.

5. The method of claim 4, wherein said spreading step includes the step of limiting the rate of flow of pulverized coal onto the conveyor by passing said pulverized coal through a restriction means located above said conveyor.

6. A fuel log formed of a mixture of coal granules and a combustible, liquid contact cement by pulverizing raw coal to form granules having diameters of no more than about 0.25 inch and, spreading the granules in no more than a few layers on a conveyor, dispensing the granules from said conveyor into a mixing hopper, laterally spraying the cement into the path of said falling particles to uniformly coat the surface of each particle and compacting the mixture into an elongate configuration.

7. The fuel log of claim 6, including a combustible covering jacket covering a surface of said log.

8. The fuel log of claim 7, further including a pair of combustible covering caps located on the ends of said logs.

9. The fuel log of claim 7, wherein said jacket includes a starter member formed therein, said starter member comprising a pull tab formed along a weakened, score line in the jacket.

10. The fuel log of claim 6, wherein said log is in the form of a cylinder.

* * * * *